United States Patent [19]

Marcolin

[11] Patent Number: 4,923,001

[45] Date of Patent: May 8, 1990

[54] INTEGRAL WATER/OIL RADIATOR, PARTICULARLY FOR VEHICLES

[75] Inventor: Dario Marcolin, Grugliasco, Italy

[73] Assignee: Fiat Auto S.p.A., Italy

[21] Appl. No.: 412,654

[22] Filed: Sep. 26, 1989

[30] Foreign Application Priority Data

Sep. 30, 1988 [IT] Italy ..... 67879 A/88

[51] Int. Cl.[5] ..... F28D 11/053

[52] U.S. Cl. ..... 165/140; 123/41.33; 165/153; 165/173; 165/916

[58] Field of Search ..... 165/140, 153, 173, 916; 123/41.33

[56] References Cited

U.S. PATENT DOCUMENTS 1,948,929 2/1934 McPherson ..... 123/41.33
2,013,708 9/1935 Bianchi ..... 165/916 X
2,264,820 12/1941 Young ..... 165/140 X
3,265,126 8/1966 Donaldson ..... 165/140
3,486,489 12/1969 Huggins ..... 123/41.33

*Primary Examiner*—Robert G. Nilson
*Attorney, Agent, or Firm*—Steele, Gould & Fried

[57] ABSTRACT

An integral water/oil radiator for a vehicle engine is described, its main characteristic being that it is composed of a single monolithic finned tube bundle provided integrally with respective cantilevered abutting cup members in correspondence with the opposing ends of a series of greater-diameter tubes, to connect said greater-diameter tubes together in a fluid-tight manner, and with a pair of chambers connected abuttingly in a fluid-tight manner to the opposing ends of the tube bundle and internally housing said cup members.

6 Claims, 2 Drawing Sheets

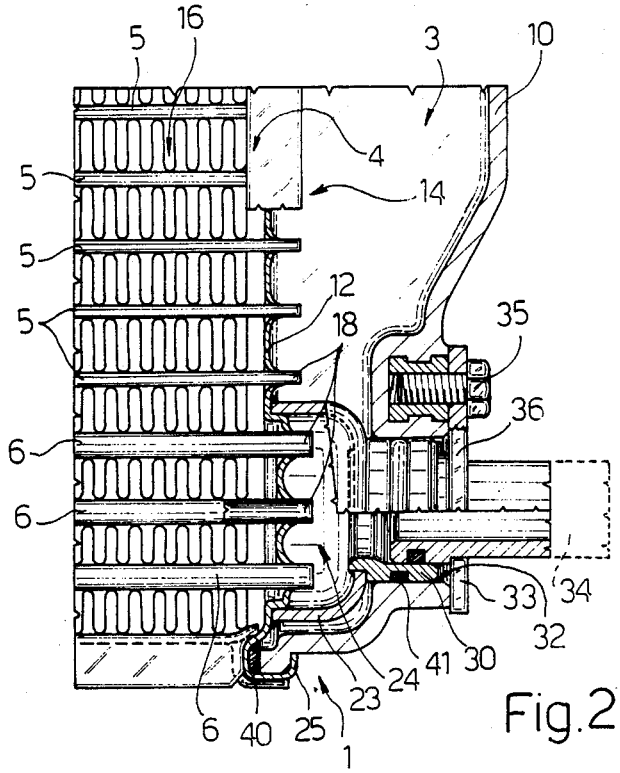
Fig.2
Fig.3
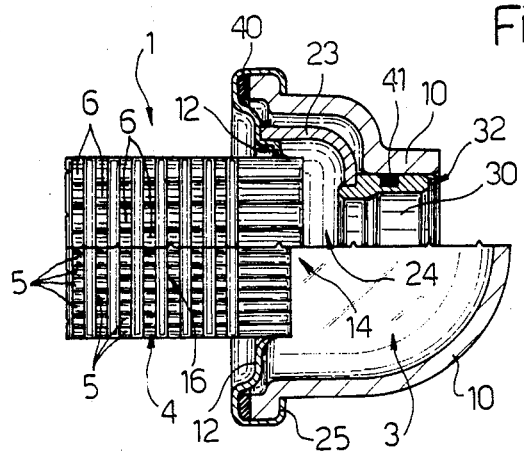

INTEGRAL WATER/OIL RADIATOR, PARTICULARLY FOR VEHICLES

BACKGROUND OF THE INVENTION

This invention relates to an integral water/oil radiator, particularly suitable for use on a vehicle to cool the water and oil used by the vehicle engine cooling circuit and lubricating circuit respectively.

It is known to cool the fluids (normally oil and water) used in the lubrication and cooling circuits of a vehicle internal combustion engine by a pair of separate radiators which are variously positioned, compatible with the overall radiator dimensions in relation to the space available, within the vehicle engine compartment usually so that they are exposed to the air flow produced by the vehicle movement.

This method on the one hand suffers from considerable space requirements, while on the other hand does not always enable the radiators to be installed in a suitable position. To overcome these drawbacks "integral" radiators have been proposed, defined substantially by a conventional water radiator shaped to allow the oil radiator to be fixed below it by bolted brackets. This method has however other drawbacks, such as a certain complexity of assembly, relatively high cost, heaviness and a reduction in the useful heat transfer surface of the oil radiator, which is housed between the vertical chambers defining the uprights of the water radiator.

SUMMARY OF THE INVENTION

The object of the invention is to provide an integral water/oil vehicle radiator which is free of the aforesaid drawbacks, and in particular is of low weight and overall size and of simple and low-cost assembly.

Said object is attained according to the invention by an integral water/oil radiator, in particular for a vehicle engine, of the type comprising a plurality of finned tubes disposed parallel to each other and connected at their opposing ends to respective header elements provided with respective pairs of pipe stubs for connection to a water and oil circulation circuit respectively, characterised in that said finned tubes define a single monolithic finned tube bundle connected abuttingly to said header elements; these latter comprising a pair of cup members defining the header elements for the oil and formed integrally with and abutting cantilevered against said tube bundle in correspondence with opposing ends of a first series of adjacent tubes of said tube bundle, these being consequently hydraulically connected together in a fluid-tight manner and hydraulically isolated from a second series of tubes defined by the remaining tubes of said tube bundle, and further comprising a pair of chambers defining the header elements for the water, which are fixed abuttingly in a fluid-tight manner to the opposing ends of said tube bundle so as to hydraulically connect together said second series of tubes, and in their interior house said cup members in a fluid-tight manner.

BRIEF DESCRIPTION OF THE DRAWINGS

The invention will be more apparent from the non-limiting description of one embodiment thereof given hereinafter with reference to the accompanying drawings in which:

FIG. 2 shows a detail of the radiator of FIG. 1 to an enlarged scale; and FIG. 3 is a plan view to an enlarged scale, shown sectioned at different levels and partly diagrammatic, of an end portion of the radiator of FIG. 1.

DETAILED DESCRIPTION OF THE INVENTION

Figure 1:
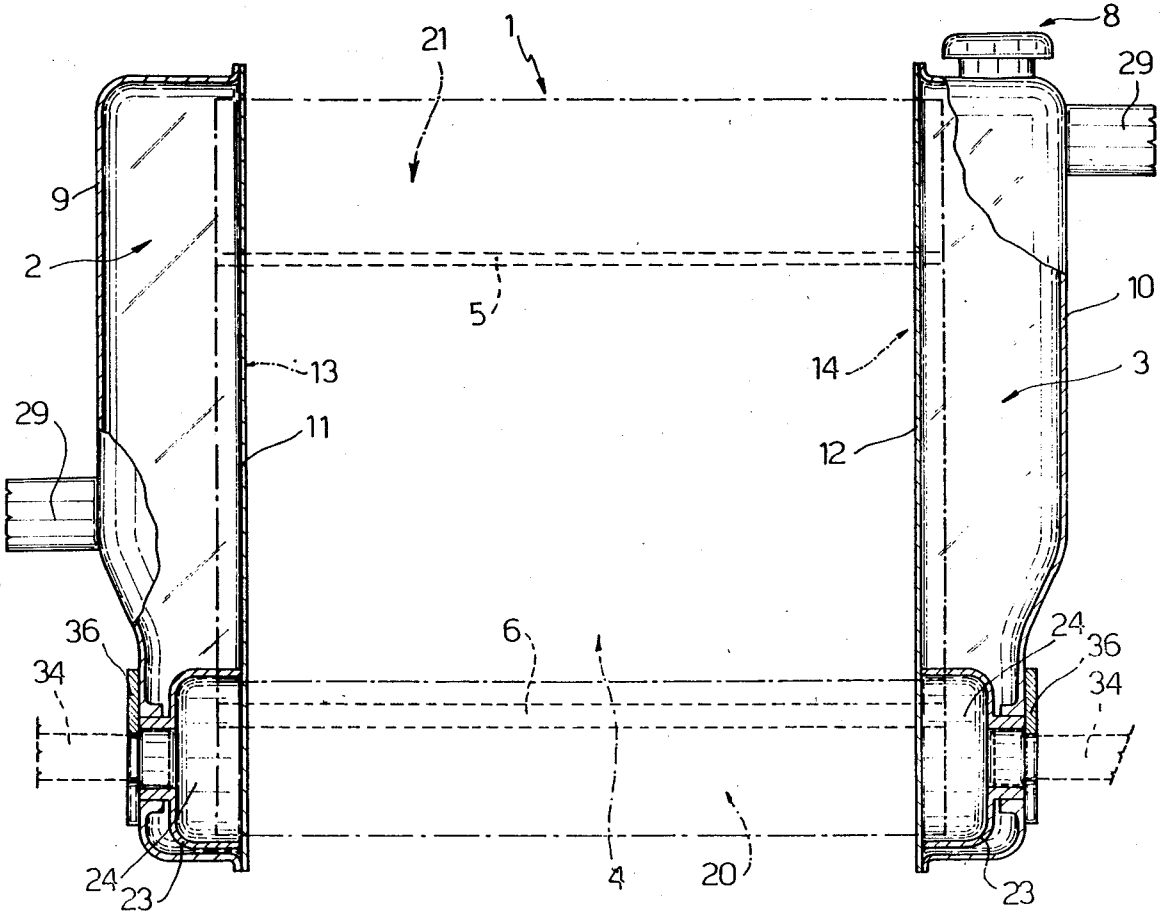
FIG. 1 is a diagrammatic longitudinal elevational view, shown partly in section, of a radiator constructed in accordance with the invention.

In FIGS. 1 to 3, the reference numeral 1 indicates overall an integral water/oil radiator particularly suitable for use on a vehicle of known type, not shown for simplicity, for cooling the working fluids of the vehicle engine such as the water (or water/antifreeze mixtures) circulating through the engine cooling circuit and the oil circulating through the engine lubrication circuit, both known and not shown for simplicity. The radiator 1 is of the horizontal tube bundle type, is of the type comprising a pair of vertical tanks 2 and 3 defining the vertical uprights of the radiator, and a horizontal finned tube bundle 4, composed in the present example of a plurality of finned tubes 5 and 6 disposed horizontally and parallel to each other in one or more rows which connect the tanks 2 and 3 together both hydraulically and mechanically to define from the structural viewpoint the connection cross-member between the tanks or uprights 2 and 3, and to define from the hydraulic viewpoint the connection element of a circulation and heat transfer circuit composed of the tube bundle 4 and the two tanks 2 and 3. One of these, namely that indicated by 3 in the present non-limiting example, is provided with a known filler 8, both tanks 2, 3 being composed of header elements defined by respective chambers 9 and 10, constructed of pressed sheet metal or of synthetic plastics material, and respective tube plates 11 and 12 for the tube bundle 4, which are constructed of shaped and punched sheet metal and define opposing longitudinal ends thereof.

The tube bundle 4, which is constructed entirely of sheet metal, preferably of high heat conduction type (such as copper, aluminium or special alloys) comprises in addition to the tube plates 11 and 12 and the tubes 5 and 6 a finned sheet metal structure 16 which is of overall known type, its end 14 being shown in detail in FIGS. 2 and 3, its other non-visible end being symmetrical, and which supports the tubes 5 and 6 passing through it. The opposing ends 18 of these latter are supported by passing through the tube plates 11 and 12, which are fitted so that they close the respective opposing ends of the finned structure 16.

According to the invention, the tube bundle 4 comprises two series of adjacent tubes, namely a first series 20 defining the lower portion of the bundle 4 composed exclusively of tubes 6, which have a greater diameter and thickness than the tubes 5, and a second series composed exclusively of tubes 5. The two tube series 20 and 21 are brazed to the structure 16 and to the tube plates 11 and 12 in a monolithic and fluid-tight manner to make the tube bundle 4 a monolithic unit which at the same time can be simultaneously traversed through its different portions, defined by the tube series 20 and 21, by fluids which are different in terms of characteristics, temperature and pressure, and in particular by water through the tubes 5 and by oil (which is known to circulate through the engine lubrication circuit at a pressure much higher than the cooling water circulation pressure) through the more robust tubes 6.

Finally, the radiator according to the invention comprises further header elements defined by respective cup members 23 which abut cantilevered against the tube bundle 4 in correspondence with the ends 18 of the series 20 of the tubes 6 and are fixed, again preferably by brazing, onto the outside of the tube plates 12 in a fluid-tight manner to project therefrom so as to be integral with the tube bundle 4 and to define, together with the tube plates 11, 12, the tubes 5 and 6 and the finned structure 16 of the bundle 4, a monolithic assembly held together by brazing and which together with the chambers 9 and 10 forms the overall radiator 1. Specifically, the cup members 23 and that portion of the tube plates 11 and 12 which connect together the tubes 5 defining said first tube series 20 define tanks 24 which are analogous to the tanks 2 and 3 but are of smaller size and are housed according to the invention within these latter, and specifically within the chambers 9 and 10. In the present example these latter are connected in a fluid-tight manner to a peripheral edge 25 of each tube plate 11, 12 by clinching so as to be fixed abuttingly cantilevered to the bundle 4 in correspondence with its ends 13, 14 and in such a manner as to define said tanks 2 and 3 in combination with said tube plates 11, 12. Such a structural arrangement means that the tubes 5, ie all those tubes of the bundle 4 forming part of the upper series 21, are connected hydraulically to the interior of the tanks 2, 3 and therefore define with the chambers 9 and 10, which act as header elements for the cooling water (or other fluid), a first hydraulic circulation and heat transfer circuit. At the same time the tubes 6, ie all those tubes of the bundle 4 forming part of the lower series 20, are hydraulically connected to the interior of the tanks 24 to define with the cup members 23, which act as header elements for the lubrication oil, a second hydraulic circulation and heat transfer circuit, which is completely isolated and separate from the first, in that the members 23 hydraulically connect together all the tubes 6 and at the same time isolate them from the remaining tubes of the bundle 4, ie from the tubes 5 of the series 21.

To enable the fluids to be cooled to enter and leave said circulation and heat transfer circuits, ie to be connected to the engine lubrication and cooling circuits, which are of known type not shown for simplicity, the chambers 9 and 10 are each provided with a respective known pipe stub 29, which in the present example is to be connected in known manner to the vehicle engine cooling circuit, whereas the cup members 23 are each provided with a respective straight pipe stub 30 which is disposed perpendicular to the corresponding chamber 9, 10 housing the respective cup member 23. Each stub 30 (of which only one is shown in FIGS. 2 and 3 as they are identical) is then engaged in a fluid-tight manner in a corresponding through seat 32 provided in the chamber 9 or 10 and is arranged to receive internally in a fluid-tight manner by insertion a corresponding connection element 33 of a tube 34, which in the present example connects to the vehicle engine lubrication circuit. The corresponding chamber 9, 10 housing each cup member 23 is then provided, in proximity to the through seat 32 for the pipe stub 30, with at least one fixing block 35 for a fixing flange 36 of the corresponding pipe 34. To ensure a hydraulic seal both between said two circulation and heat transfer circuits and towards the outside of the radiator 1, respective seal gaskets 40 and 41 are inserted between the chambers 9, 10 and tube plates 11, 12 and between the pipe stubs carried by the cup members 23 and the respective through seats 32 provided in the chambers 9, 10, so that they become compressed when fitting the chambers 9, 10 onto the ends of the monolithic unit formed by the tube bundle 4 and headers 23. This unit is preferably formed by assembling the component elements in known manner and then placing the semi-finished unit in a brazing furnace, in which the joints between the components are fused to provide the monolithic characteristic of the unit in a rapid and economical manner.

When in use, the water of the engine cooling circuit enters one of the two tanks 2, 3, then passes through the tubes 5 and leaves from the other tank without being able to penetrate into the tanks 24 and tubes 6. The oil of the lubrication circuit enters a tank 24 and passes through the tubes 6 to reach the other receiver, from which it is recirculated. In passing through the tubes 6 the oil cools simultaneously with the water flowing through the tubes 5, so substantially using the same radiating mass as used by the water and defined by the finned structure 16.

The advantages of the invention are apparent from the description. By virtue of the special described structure, a composite oil/water radiator is obtained by the same methods and with the same cost and overall size as the conventional water radiator alone, with the further advantage of no reduction of radiating surface in that part of the tube bundle which serves the heat transfer sub-unit acting as the oil radiator, as the headers 23 are incorporated in the headers of the water radiator defined by the chambers 9, 10. The composite unit obtained in this manner is also of low weight and dispenses with all joining problems using brackets or other similar connection members typical of the known art, thus considerably simplifying its mounting onto the vehicle and also its maintenance when in use.

I claim:

1. An integral water/oil radiator, in particular for a vehicle engine, of the type comprising a plurality of finned tubes disposed parallel to each other and connected at their opposing ends to respective header elements provided with respective pairs of pipe stubs for connection to a water and oil circulation circuit respectively, characterised in that said finned tubes define a single monolithic finned tube bundle connected abuttingly to said header elements; these latter comprising a pair of cup members defining the header elements for the oil, formed integrally with and abutting cantilevered against said tube bundle in correspondence with opposing ends of a first series of adjacent tubes of said tube bundle, these being consequently hydraulically connected together in a fluid-tight manner and hydraulically isolated from a second series of tubes defined by the remaining tubes of said tube bundle, and further comprising a pair of chambers defining the header elements for the water, which are abuttingly fixed in a fluid-tight manner to the opposing ends of said tube bundle so as to hydraulically connect together said second series of tubes, and in their interior house said cup members in a fluid-tight manner.

2. A radiator as claimed in claim 1 in which the tubes of said tube bundle are disposed horizontally, characterised in that said first series of tubes has a diameter greater than the diameter of the tubes of said second series, and defines the lower portion of said tube bundle.

3. A radiator as claimed in claim 1, characterised in that said cup members are each provided with a respective pipe stub, said pipe stub being engaged in a fluid-tight manner within a corresponding through seat in the chamber.

4. A radiator as claimed in claim 3, characterised in that said pipe stub of each said cup member is arranged to receive in a fluid-tight manner in its interior, by insertion, a corresponding connection element for a pipe, the corresponding said chamber which houses the cup member being provided in proximity to said seat with at least one anchor block for the pipe fixing flange.

5. A radiator as claimed in claim 1, characterised in that said tube bundle comprises a plurality of tubes disposed parallel to each other, a finned structure of sheet metal supporting said tubes, which pass through it, and a pair of tube plates supporting respective opposing ends of said tubes, which pass through it, and applied to close respective opposing ends of said finned structure, said cup members being fixed onto the outside of said tube plates so that they project therefrom to define with these latter, with said tubes and with said finned structure, a monolithic structure held together by brazing and comprising said tube bundle and respective first tanks defined by said cup members and by said tube plates and connecting said first series of tubes together.

6. A radiator as claimed in claim 5, characterised in that said chambers are connected in a fluid-tight manner to the peripheral edge of said tube plates by clinching, to define with these latter second tanks housing said first tanks and connecting said second series of tubes together; respective seal gaskets being inserted between said chambers and sad tube plates and between said pipe stubs carried by the cup members and the respective through seats provided in said chambers.

* * * * *